United States Patent [19]

Miller

[11] 4,212,185

[45] Jul. 15, 1980

[54] HYDRAULIC PRESS SYSTEM

[75] Inventor: Donald E. Miller, Mt. Prospect, Ill.

[73] Assignee: The Continental Group, Inc., New York, N.Y.

[21] Appl. No.: 21,283

[22] Filed: Mar. 16, 1979

[51] Int. Cl.[2] ..... B21J 9/10

[52] U.S. Cl. ..... 72/354; 72/450; 72/453.04; 72/453.18

[58] Field of Search ..... 72/354, 347, 352, 353, 72/358, 351, 450, 465, 453.01, 453.18, 453.04

[56] References Cited

U.S. PATENT DOCUMENTS

| | | | |
|---|---|---|---|
| 2,417,794 | 3/1947 | Werner | 72/417 |
| 3,108,502 | 10/1963 | Chatfield | 72/354 |
| 3,138,257 | 6/1964 | Andersen | 72/431 |
| 3,456,478 | 7/1969 | Alexander | 72/351 |
| 3,861,191 | 1/1975 | Sato | 72/354 |

*Primary Examiner*—Francis S. Husar
*Assistant Examiner*—Gene P. Crosby
*Attorney, Agent, or Firm*—Charles E. Brown

[57] ABSTRACT

A press structure wherein the usual crank mechanism is utilized solely for the movement of the press tooling and forging pressure is exerted by way of load cylinders interconnecting the press ram and load beam so that the press ram and load beam are drawn together under the influence of high pressure hydraulic fluid within the load cylinders. A minimum volume of high pressure hydraulic fluid is required to exert the forging pressure and, accordingly, the work efficiency of the press is much greater than that experienced with other press systems.

11 Claims, 10 Drawing Figures

HYDRAULIC PRESS SYSTEM

This invention relates in general to new and useful improvements in reciprocating forging presses, and more particularly to a forging press wherein the ram is mechanically reciprocated by means of a crank assembly, but wherein the forging pressure is produced hydraulically.

This invention particularly relates to a forging press wherein an elongated tubular member, such as a container, is formed from a slug. As the slug is reduced in thickness, the slug is also moved through a die sleeve so that the working stroke of the punch is very great, the stroke of the punch being equal to the height of the tubular body plus the amount of reduction in thickness of the slug. If the forging pressure was delivered by the punch solely by means of a reciprocating ram, very much power would be required to effect the forging operation. On the other hand, by moving the tooling by way of a crank actuated ram and utilizing a separate hydraulic system to provide the forging pressure, minimal work is required.

In accordance with this invention, the ram is coupled to the load beam by one or more load cylinders which are associated with a source of high pressure hydraulic fluid so that, as the ram moves downwardly and the load beam also moves downwardly therewith, the ram and load beam are being drawn together by the load cylinder to apply the necessary forging pressure on the slug which is being deformed.

Also in accordance with this invention, the hydraulic system includes a low pressure hydraulic source and a high pressure hydraulic source so that hydraulic fluid at the high pressure is delivered to the load cylinder only when the punch is in engagement with the slug being formed, thereby reducing the work required to a minimum.

The load beam is supported by a fluid cylinder which maintains the beam in its uppermost position prior to the start of forging and most particularly retains the load beam in its lower position so that the punch may be stripped from the formed tubular member, after which the formed tubular member may be forced from the die sleeve.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
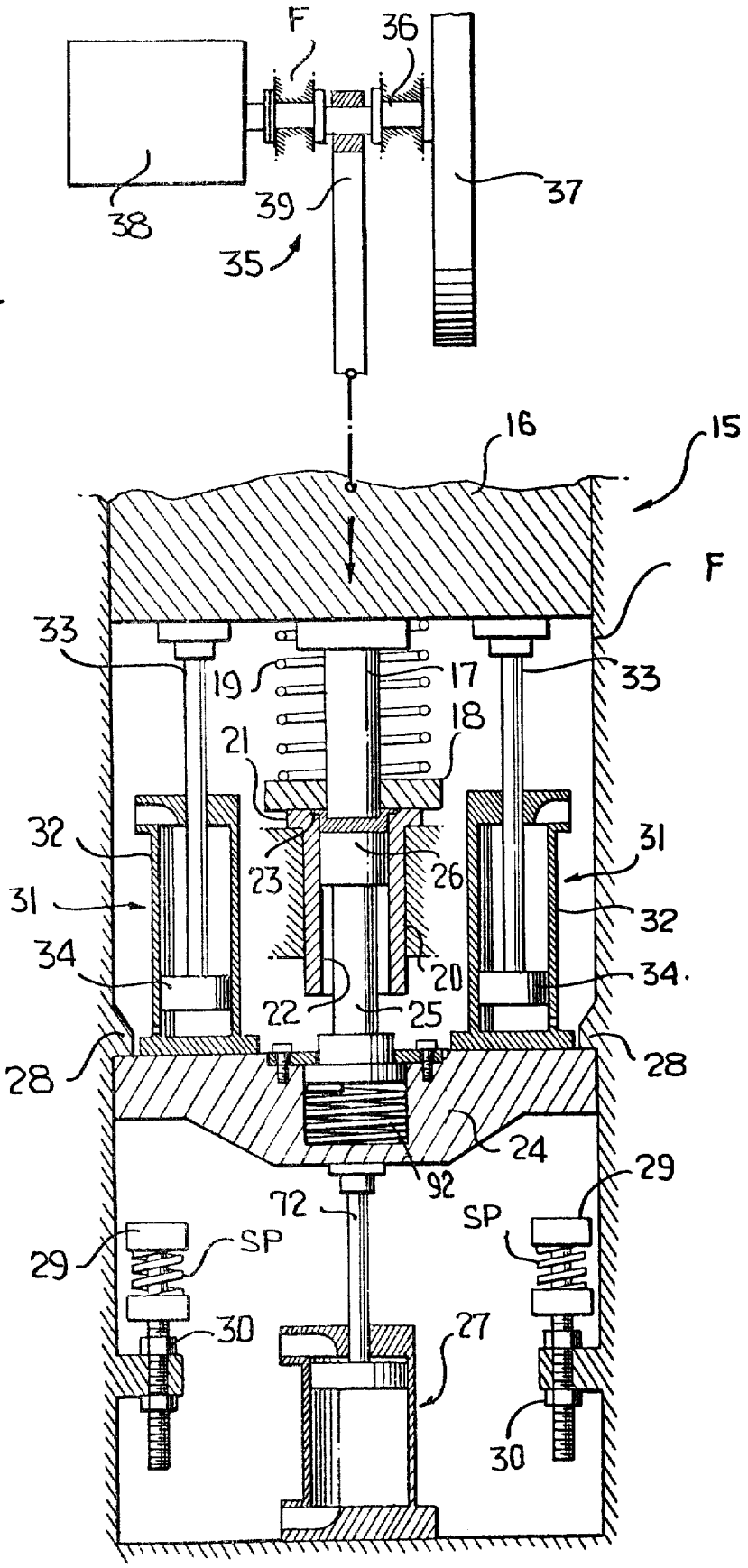
FIG. 1 is a schematic sectional view taken through a forging press formed in accordance with this invention.

Referring now to the drawings in detail, it will be seen that there is illustrated in FIG. 1 a press structure generally identified by the numeral 15. The press structure 15 includes a frame F of which only parts are shown. A ram 16 is mounted within the frame F for guided vertical reciprocatory movement. The ram carries a punch 17 and a flange clamp 18, with the flange clamp 18 being movable relative to the punch 17 and being urged to a projected position by suitable means such as a spring 19.

The press 15 also includes a die sleeve 20 Which is open at both ends and which includes a flange 21 which seats on a portion of the frame F. The die sleeve 20 includes a bore 22 which determines the external diameter of the tubular body being formed, and the flange 21 has formed in the upper surface thereof a recess 23 which forms a continuation of the bore 22 and which is of a size to define a container flange to be discussed hereinafter.

The press 15 also includes a load beam 24 which is mounted within the frame F for vertical guided movement below the die sleeve 20. The load beam carries an upstanding support 25 which, in turn, supports a pad 26 at its upper end. The pad 26 is slidably mounted within the die sleeve 20 for cooperation with the punch 17.

The load beam 24 is supported by a beam cylinder 27 and is initially held in an uppermost position against top stops 28 formed by or carried by parts of the frame F. The downward movement of the load beam 24 is restricted by bottom stops 29. It is also to be noted that each bottom stop 29 is provided with a vertically adjustable support arrangement 30 and includes a spring pack SP so that the bottom stops 29 may move downwardly under loading from the load beam 24 for a purpose to be described hereinafter.

Most particularly, in accordance with this invention the ram 16 is interconnected with the load beam 24 by at least one load cylinder, generally identified by the numeral 31. It is, of course, desirable to have two of the load cylinders. At this time it is pointed out that while only one set of tooling has been illustrated, the press may be provided with multiple sets of tooling.

Each load cylinder 31 has the cylinder component 32 thereof rigidly attached to the load beam 24 and the piston rod 33 thereof rigidly attached to the ram. Each load cylinder also includes a reciprocal piston 34.

The press structure thus described will have associated therewith a drive mechanism generally identified by the numeral 35. The drive mechanism 35 includes a crankshaft 36 which is suitably journalled in a portion of the frame F and which carries at one end the usual fly-wheel 37. For purposes of illustration, an electric motor 38 is coupled to the opposite end of the crankshaft 36 to effect rotation thereof. A connecting rod 39 journalled on the crankshaft 36 has the opposite end thereof attached to the ram 16 in a conventional manner to effect reciprocation of the ram and thus actuation of the press tooling.

Figure 2:
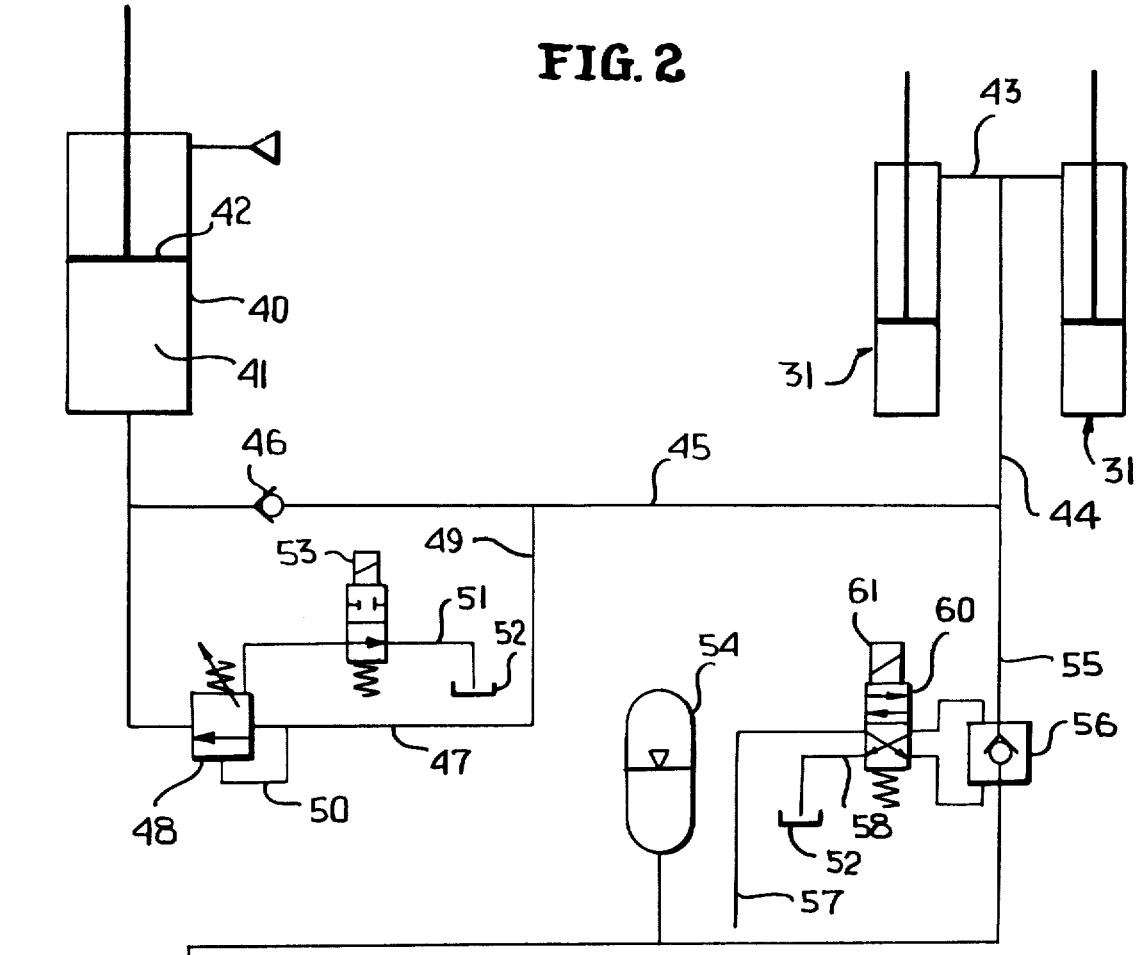
FIG. 2 is a diagrammatic view of the hydraulic system for the load cylinders.
Figure 2:
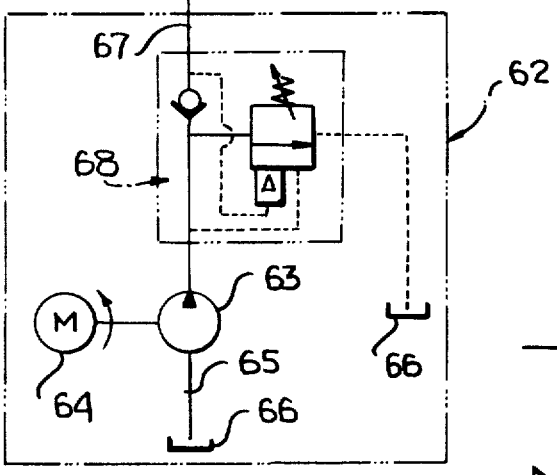

Reference is now made to FIG. 2 wherein the hydraulic system for the load cylinders 31 is illustrated. First of all, the hydraulic system includes a low pressure hydraulic reservoir 40 wherein hydraulic fluid 41 is maintained at a predetermined pressure by way of a piston 42 under the influence of air under pressure on the order of 40/60 p.s.i.g. The upper ends of the load cylinders 31 are interconnected by a hydraulic line 43 which has coupled thereto a main hydraulic line 44. A hydraulic line 45 extends from the hydraulic supply of the reservoir 40 to the hydraulic line 44 with a check valve 46 incorporated therein, the check valve 46 permitting hydraulic fluid to flow only from the reservoir to the load cylinders 31.

A return line 47 bypasses the check valve and has mounted therein a return or relief valve 48 which is normally closed and which is moved to an open position under the influence of a solenoid actuated pilot valve 49. The relief valve 48 is actuated by way of a source of hydraulic fluid from the line 47 through a line 50. Normally the relief valve 48 is vented through a vent line 51 which leads into a reservoir or tank 52. When the solenoid 53 of the solenoid controlled pilot valve 49 is energized, the valve 49 shifts to block the venting of the control for the relief valve 48, thus shifting the relief valve to a closed position preventing the return of hydraulic fluid through the relief or return line 47 to the reservoir 40, unless the pressure rises above the manually-set relieving pressure of the valve. This manually-set pressure is established by equipment safety considerations and is well above the maximum normal operating pressure of the system.

The high pressure hydraulic fluid source includes an accumulator 54 which is coupled to a high pressure line 55 which, in turn, is connected to the hydraulic line 44. A pilot operated check valve 56 is incorporated in the fluid line 55 for controlling the flow of hydraulic fluid to the load cylinders 41. The control for the check valve 56 includes a pilot supply line 57 and a return line 58 with the return line 58 being connected to the drain or tank 52. A control valve 60 is incorporated in the pilot supply line 57 and the return line 58. A control valve 60 is actuated by means of a solenoid 61 and normally serves to maintain the check valve 56 in its closed position.

Hydraulic fluid is supplied to the line 55 and the accumulator 54 by a high pressure system 62. The high pressure system 62 includes a pump 63 driven by a suitable motor 64 and receiving a hydraulic fluid supply through a supply line 64 coupled to the tank 66. The supply system 62 includes a supply line 67 which is coupled to the hydraulic line 55. In the supply line 67 there is mounted an unloader generally identified by the numeral 68. The unloader 68 serves to maintain hydraulic fluid within the accumulator 54 at the preselected pressure with a minimum of high pressure operation of the pump 63. The pressure of the hydraulic fluid within the accumulator 54 is on the order of 3,000 p.s.i.g.

Figure 3:
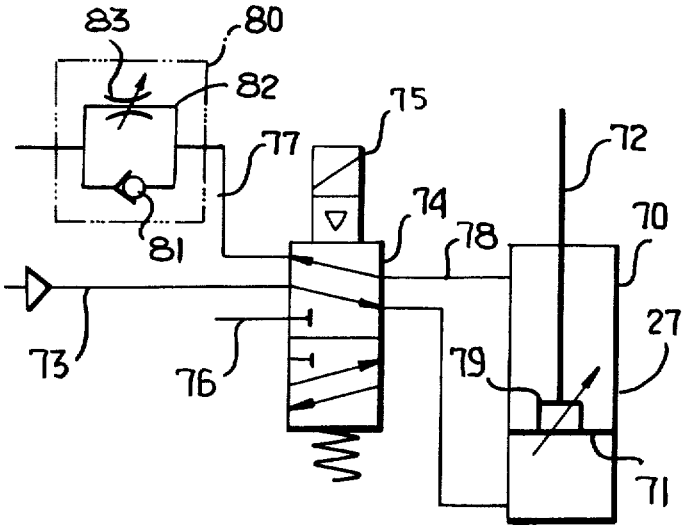
FIG. 3 is a diagrammatic view showing the pneumatic system for the load beam cylinder.
Figure 4:
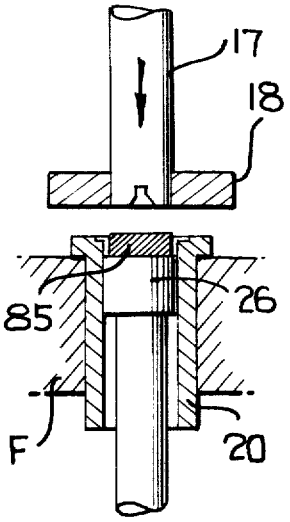
FIGS. 4–10 are schematic sectional views showing the operation of the press tools in the formation of a flanged container having an integral end.

Reference is now made to FIG. 3 wherein there is illustrated an air system for the beam cylinder 27. It will be seen that the beam cylinder 27 includes a cylinder component 70 in which there is a piston 71 having extending therefrom a piston rod 72 rigidly coupled to the load beam 24. Fluid is directed into the piston end of the cylinder 27 from an air supply 73 through a control valve 74 which is provided with a solenoid type actuator 75. The valve 74 also has associated therewith vent lines 76 and 77.

Vent line 77, which exhausts the rod end of cylinder 24 by means of line 78, is connected to a flow control valve 80. Valve 80 contains an internal passage 82 leading to an adjustable restrictor 83, and also a check valve 91. Cylinder 27 is equipped with an adjustable rod-end cushion 79.

Figure 5:
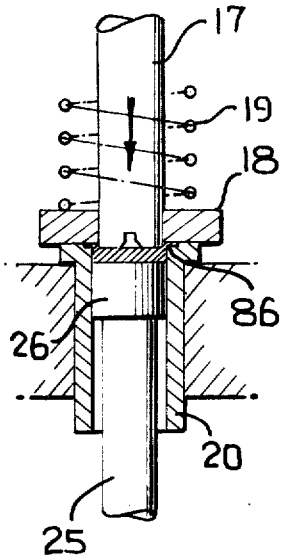

In accordance with this invention, with reference to the diagrammatic illustrations of FIGS. 4–10, the drive mechanism 35 is actuated to force the ram 16 downwardly. As the ram 16 moves downwardly, hydraulic fluid flows into the load cylinders 31 from the low pressure supply reservoir 40. Thus the cylinders 31 remain full at all times. The punch 17 moves down with the ram 16, as does the flange clamp 18. At the moment the punch engages a slug 85 seated on the pad 26, suitable control means actuate the pilot supply control valve 60 to open the check valve 56 which directs into the load cylinders 31 hydraulic fluid at a high pressure. This results in the ram being drawn toward the load beam and the exertion of a forging pressure on the slug 85 by the punch 17 and the pad 26. The initial forging action results in the forming of a flange 86, as is shown in FIG. 5.

As the condition shown in FIG. 5 reaches completion, the load beam is subjected to a very high acceleration. The reason for this is that it has been at rest prior to the time the condition of FIG. 5 impends, while the ram has been moving through a high velocity portion of the press stroke. If the load beam is of low weight and the slug material has sufficient resilience, the required acceleration will take place without the development of excessive force. On the other hand if the beam is relatively massive and highly rigid, an impulsive force of extreme magnitude may arise. To prevent the development of excessive force during acceleration, a force limiting device such as a high-force, preloaded spring assembly can be incorporated within the load beam, as shown at 92 in FIG. 1.

The punch 17 continues its downward movement while the flange clamp 18 remains fixed relative to the die sleeve 20. At the same time the pad 26 is moving down together with the load beam 24 which was initially held against the stops 28 by the air pressure within the bottom of the beam cylinder 27. The check valve 81 permits atmospheric air to enter the rod end of the cylinder 27 during the downward movement.

At this time it is pointed out that the punch 17 and pad 26 are being actuated by the mechanical drive mechanism 35, but that the forging pressure is exerted solely by the load cylinders 31.

Figure 6:
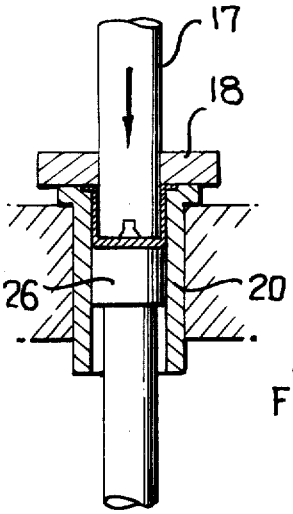
Figure 7:
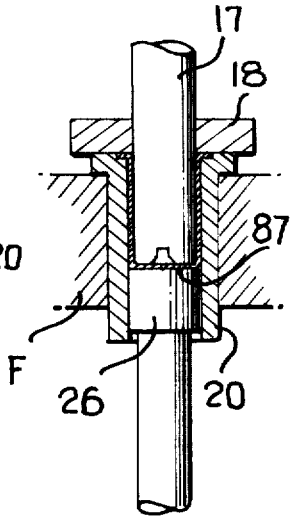
Figure 8:
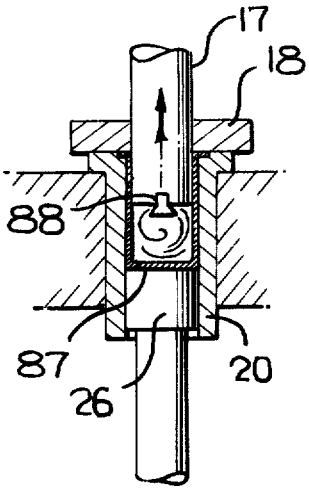

As the downstroke of the punch 17 and pad 27 continues as shown in FIGS. 6 and 7, the forming of the container body continues and the thickness of the slug gradually decreases until a fully formed container 87 is developed, as shown in FIG. 7. At about this time the load beam 24 should strike the bottom stops 29.

The downstroke of the press ends when the crank of the drive mechanism 35 reaches its bottom dead center position. At this time the check valve 56 closes and the relief valve 48 opens so that the load cylinders 31 are connected to the low pressure hydraulic fluid reservoir 40 for the return flow of hydraulic fluid thereto. At the same time, air is directed into the upper end and exhausted from the lower end of the beam cylinder 27 to hold the beam cylinder against the bottom stops 29. Also, at this time air is directed through the punch 17 to a punch air valve 88, thus urging the container 87 to be retained within the die sleeve 20.

The press upstroke begins with the load beam weight, punch air and, if needed, air applied to the rod side of the beam cylinder combining to hold the load beam against the bottom stops 29.

The upstroke of the punch 17 and ram 16 continues with the punch being withdrawn from the die sleeve 20. Hydraulic fluid continues to flow out of the load cylinders 31 into the reservoir 40.

With the rod end of the beam cylinder being connected to the restricted passage 82 and with air now being directed into the piston end of the load cylinder, the load beam 24 and the pad 26 now rise, with the rate of rise being regulated by the rate of exhaust air flow from the rod end of the beam cylinder. It is to be understood that the load cylinders 31 also assist in the elevation of the load beam and the pad 26. At this time it is pointed out that at the beginning and near the end of the pad rise, hydraulic fluid flows out of the load cylinders 31. However, at peak speed of rise, hydraulic fluid may flow back into the load cylinders. This will occur if the rise velocity of the load beam should exceed the upstroke velocity of the ram for a brief period.

The load beam 24 moves up until it engages the top stops 28. It is to be understood that the load beam may be decelerated as it approaches the top stops 28 by means of the rod end cushion 79 in the beam cylinder, or by small shock absorbers mounted either in the top stops 28 or the beam 24 (not shown).

Figure 9:
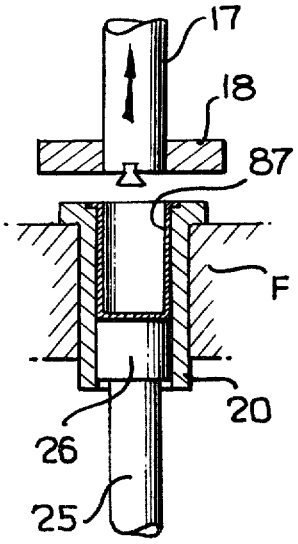
Figure 10:
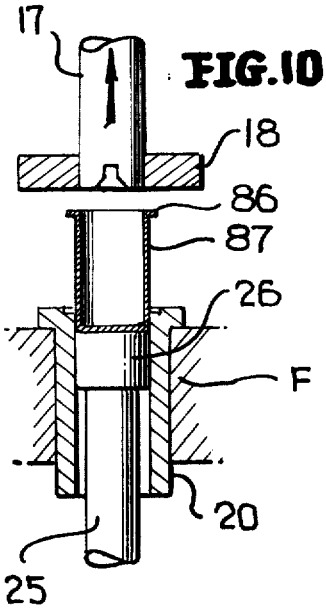

The upstroke of the ram 16 continues as the crank 36 moves toward its top dead center position. Outfeed of the container occurs at this time. These final steps are schematically illustrated in FIGS. 9 and 10.

It should be noted that the travel of the load cylinder pistons 34 during the forging operation equals the thickness of reduction of the slug 85 which is on the order of 0.2 inch. The quantity of the high pressure hydraulic fluid used is, therefore, modest. For example, with the 3,000 p.s.i.g. high pressure supply, the hydraulic fluid flow required to produce forty-five containers per minute at 30 tons forging load is about 1.5 g.p.m., including pressurization needs.

From the foregoing it will be seen that the work expended is held to a minimum with practically no loss. The downward movement of the load beam 24 is so controlled whereby theoretically it will come to a stop just before it engages the bottom stops 29, and thus no work loss is involved in stopping the movement of the load beam. The bottom stops are, however, resiliently mounted to accept the condition where a previously formed container may not have been ejected.

The resiliently mounted bottom stops also take care of the situation of double slug feed or instances where the slug does not forge properly to provide for the necessary reduction in thickness.

Although no specific means for actuating the solenoids of the various valves has been specifically illustrated and described, it is pointed out here that any simple control mechanism may be utilized and normally this control mechanism will be driven from the crank 36, although the control mechanism could be actuated by the position of the ram 16.

It is also pointed out here that only those portions of the hydraulic system essential to the operation of the press have been illustrated, and that elements such as manual fill and drain valves, reservoir level controls and over-pressure relied valves, etc., have been omitted for purposes of clarity.

Although only a preferred embodiment of the press has been specifically illustrated and described herein, it is to be understood that minor variations may be made in the press system without departing from the spirit and scope of the invention as defined by the appended claims.

I claim:

1. A press structure for attachment to a mechanical press of the type including a frame and a reciprocating ram, said press structure comprising a die sleeve having means for fixedly mounting said die sleeve relative to said press frame, a load beam, a die pad carried by said load beam for movement within said die sleeve, means mounting said load beam for movement relative to said die sleeve, a punch carried by said ram for movement through said die sleeve and for cooperating with said pad to form a closed end tubular member, and at least one load cylinder connecting said ram and said load beam for movement generally in unison and controlled relative movement, said load cylinder being a hydraulic cylinder, a low pressure hydraulic fluid source and a high pressure hydraulic fluid source, means for connecting said low pressure hudraulic fluid source to said load cylinder for filling said load cylinder during movement of said ram and punch from a top dead center position to a workpiece engaging position, and means for connecting said high pressure hydraulic fluid source to said load cylinder substantially at the time said punch engages a workpiece to apply a forging pressure connection between said ram and said load beam.

2. The press structure of claim 1 wherein movement of said load beam relative to said ram during forging is restricted by said load cylinder to movement towards said ram.

3. The press structure of claim 1 wherein movement of said load beam relative to said ram during forging is restricted by said load cylinder to movement towards said ram, and said movement is restricted to the reduction in thickness by a workpiece disposed between said punch and said pad.

4. The press structure of claim 1 together with stop means carried by said frame for limiting movement of said load beam in opposite directions.

5. The press structure of claim 4 wherein said stop means includes fixed top stops and resilient bottom stops.

6. The press structure of claim 1 wherein said means for connecting said low pressure hydraulic fluid source to said load cylinder includes a check valve and a normally closed relief valve disposed in parallel, and control means for actuating said relief valve.

7. The press structure of claim 1 wherein said high pressure hydraulic source includes an accumulator for maintaining an instantaneous supply of high pressure hydraulic fluid.

8. The press structure of claim 1 wherein said means for connecting said high pressure hydraulic source to said load cylinder includes a normally closed pilot controlled check valve, and means for actuating said pilot control.

9. The press structure of claim 1 together with a fluid cylinder for supporting said load beam.

10. The press structure of claim 9 wherein said load beam fluid cylinder is a double acting cylinder, and there is an associated fluid system for actuating said load beam fluid cylinder separate from said load cylinder.

11. The press structure of claim 10 wherein said fluid system includes means for limiting the return rate of said load beam.

* * * * *